United States Patent [19]

Speckhart

[11] Patent Number: 4,520,703

[45] Date of Patent: Jun. 4, 1985

[54] ELECTROMOTIVELY DRIVEN HOUSEHOLD SLICING MACHINE FOR FOOD

[75] Inventor: Max Speckhart, Traunstein, Fed. Rep. of Germany

[73] Assignee: BOSCH-SIEMENS HAUSGERAETE GmbH, Stuttgart, Fed. Rep. of Germany

[21] Appl. No.: 495,767

[22] Filed: May 18, 1983

[30] Foreign Application Priority Data

May 18, 1982 [DE] Fed. Rep. of Germany ..... 3228768
Jun. 23, 1982 [DE] Fed. Rep. of Germany ..... 3223450

[51] Int. Cl.[3] ..... B26D 4/28

[52] U.S. Cl. ..... 83/478; 83/707; 83/571; 83/666; 83/860

[58] Field of Search ..... 83/707, 703, 440.2, 83/478, 544, 860, 666, 665

[56] References Cited

U.S. PATENT DOCUMENTS

| | | | |
|---|---|---|---|
| 4,116,099 | 9/1978 | Mayer | 83/707 X |
| 4,246,821 | 1/1981 | Fuse | 83/707 |
| 4,273,013 | 6/1981 | Artin et al. | 83/707 X |
| 4,345,498 | 8/1982 | Best | 83/707 |

*Primary Examiner*—Donald R. Schran
*Attorney, Agent, or Firm*—Herbert L. Lerner; Laurence A. Greenberg

[57] ABSTRACT

An electromotively driven household slicing machine for food, includes a main housing, a cutting tool for cutting food, an integral electromotive drive module for driving the cutting tool, the drive module having its own housing and being lockable to and easily detachable from the main housing, and a device disposed on the main housing for centering and connecting the cutting tool to the drive module in an operating position.

12 Claims, 8 Drawing Figures

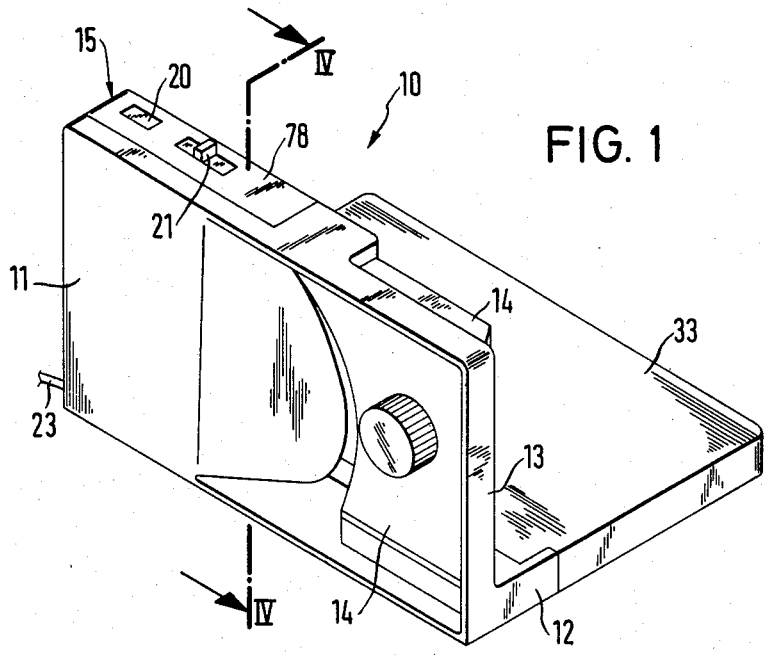
FIG. 1
FIG. 2
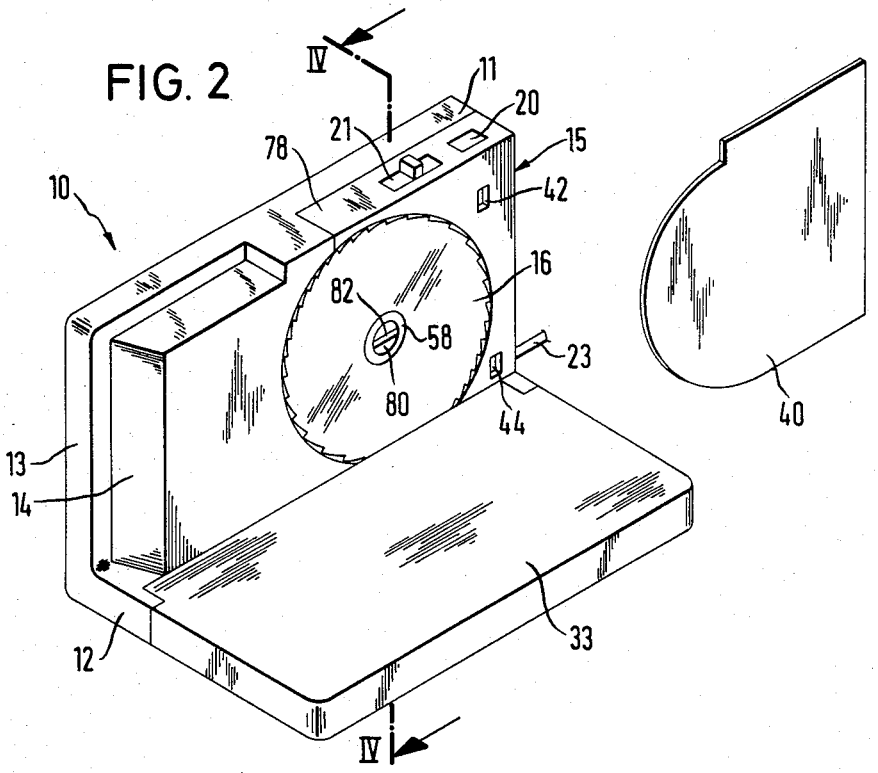

ELECTROMOTIVELY DRIVEN HOUSEHOLD SLICING MACHINE FOR FOOD

The invention relates to an electromotively driven household slicing machine for food, in particular a circular knife slicing machine, with a housing and a cutting tool which acts on the food to be cut, the cutting tool being driven by an electromotive drive in the form of an integral drive module enclosed in its own housing, which is form-lockingly and easily detachably connected to the housing.

A device of this type is known from German Published, Non-Prosecuted Application DE-OS 25 29 352. The universal slicing machine with a circular knife which is described therein, has the disadvantage of requiring the detached knife to be clamped to the detached drive module, which can lead to serious injuries during its use. Furthermore, if the drive module is disposed at the side of the housing facing away from the knife, a separating gap is formed at the rear deflection surface for the cut or sliced food, in which dirt can collect.

It is accordingly an object of the invention to provide an electromotively driven household slicing machine for food, which overcomes the hereinafore-mentioned disadvantages of the heretoforeknown devices of this general type, and to create a slicing machine of this type which is easier to operate, especially with respect to the safety it provides against injuries caused by the knife.

A further basic objective of the invention is to increase the safety of a slicing machine, especially a circular knife slicing machine for food, with a housing to which a cutting tool assembly (with a cutting tool, which acts on the food to be cut) is fastened by a locking device, so that it can be regularly detached. The security against injuries during the removal and installation of the cutting tool and during storage of the cutting tool is greatly increased, and the cutting edges of the cutting tool are protected against damage.

With the foregoing and other objects in view there is provided, in accordance with the invention, an electromotively driven household slicing machine for food, especially a circular knife slicing machine, comprising a main housing, a cutting tool for cutting food, an integral electromotive drive module for driving the cutting tool, the drive module having its own housing and being form-lockable to and easily detachable from the main housing, and means disposed on the main housing for centering and connecting the cutting tool to the drive module in an operating position. In this case, the drive module and the cutting tool cannot be directly connected and locked or centered with respect to each other. The housing is always required for making the connection, which can only be produced if the device is properly put together. It is also impossible to detach the drive module or the cutting tool separately from the operating position, which would provide individual units that are dangerous. The connection is automatically broken when they are both taken off.

In accordance with another feature of the invention, the centering and connecting means includes a bearing element in contact with the drive module and another bearing element in contact with the cutting tool. Two adjacent sections of one bearing surface may also be used. The centering device can also have two separate bearing elements, which are connected with each other by the housing, and which together form the centering device.

In accordance with a further feature of the invention, the cutting tool is a rotating tool, such as a circular knife, having an axis of rotation, and the centering and connecting means are disposed in vicinity of the axis of rotation of the cutting tool.

In accordance with an added feature of the invention, the main housing has an inner wall, and the centering and connecting means is in the form of a bushing, serving as a bearing element for the drive module and the cutting tool, projecting from the inner wall coaxially to the axis of rotation of the cutting tool, the bushing having a bearing surface on the outer periphery thereof for the drive module and a bearing surface on the inner periphery thereof for the cutting tool. This construction has the advantage of having relatively small tolerance problems, because the bearing surfaces for the drive module and the cutting tool are located on the same easily machinable part. This part can be machined with great accuracy by itself in a simple manner, and can be connected with the applicance housing in a fixed position at the assembly.

In accordance with an additional feature of the invention, the main housing includes means for fastening the drive module and the cutting tool. The fastening means may be preferably constructed as tensioning means, for example, in the form of spirally guided bayonet prongs.

In accordance with again another feature of the invention, the fastening means are clamping means.

In accordance with again a further feature of the invention, the cutting tool includes a stationary bearing part having a first connection element, and the centering and connecting means includes a second connection element cooperating with the first connection element. The two connection elements may form a conventional bayonet connection with spiral bayonet prongs for securely holding the parts. The placement of the connection device in the centering device results in a simple construction, and if the centering device is disposed in vicinity of the axis of a rotating cutting tool, the servicing is made simple by means of the stationary axis of the cutting tool, which extends through the actual cutting tool, and permits the operation of the connecting device through the cutting tool.

In accordance with again an added feature of the invention, the drive module is held between the main housing and the stationary bearing part of the cutting tool by the connection elements.

In accordance with again an additional feature of the invention, the drive module is clamped in axial direction of the cutting tool by the connection elements. In this way, the shared connection devices serve for the fixed positioning of the cutting tool and the drive module at the housing, while a simple construction is made possible. By virtue of the combined mounting of the cutting tool and the drive module, these parts are centered with respect to each other in the axial direction of the axis of rotation, in the most simple way.

In accordance with yet another feature of the invention, the cutting tool includes a gear and is rotatable about an axis of rotation, the drive module includes a bearing lug or socket being coaxial to the axis of rotation of the cutting tool in the operating position, the centering and connecting means includes a bearing element cooperating with the socket, and the drive module includes a drive pinion disposed to the side of the socket and cooperating with the gear.

In accordance with yet a further feature of the invention, the cutting tool includes a stationary bearing part disposed at an end face of the socket. Thus, centering in various directions is effected by closely adjacent surfaces at the drive module as well as at the cutting tool, thereby facilitating the manufacture of these parts, and permitting the machining of centering surfaces of a part without rechucking, or even in one operation during its manufacture.

In accordance with yet an added feature of the invention, the main housing has a side where food is sliced, and the drive module is insertable into or attachable to the housing from the side thereof. This has the advantage of ensuring that the deflection surface for the sliced food is not interrupted by a separating gap in which dirt can collect. This deflection surface can be a continuous smooth surface, which improves the usability and also enhances the appearance of the machine. Furthermore, this results in the advantage that the cutting tool and the drive module are taken off and reinserted again in the same direction. This makes servicing the machine easier, when the machine is taken apart for cleaning purposes, and then put together again. In particular, the housing with its shell-like part for retaining the drive module can therefore lie flat on a table with its open side or knife side upward, and the drive module and the cutting tool can be inserted from the top. This operation is very simple and safe, and avoids the danger of tilting the whole appliance if the assembly is done by an unskilled person at the stationary appliance, so that the servicing and especially the safety again is considerably improved. Furthermore, the structure simplifies the construction of the machine, so that the manufacturing cost is also reduced.

In accordance with yet an additional feature of the invention, the main housing and the cutting tool are connectible together by the drive module.

In accordance with still another feature of the invention, there is provided a slicing machine, especially a circular knife food slicer, comprising a housing, a cutting tool assembly having a side facing away from the housing, the cutting tool assembly including a cutting tool having a cutting edge for slicing and means for detachably locking the cutting tool assembly to the housing, and a protective shield being fastenable to the cutting tool assembly and protruding beyond the cutting edge at the side of the cutting tool assembly facing away from the housing, the protective shield including a built-in wrench or key for operating the locking means. In this way, the cutting tool assembly can only be detached from the housing of the slicing machine with the protective shield attached to the cutting tool assembly.

In accordance with still a further feature of the invention, there is provided a sliding or locking safety latch for latching the protective shield to the cutting tool assembly, the safety latch being operable in cooperation with the housing for detaching the protective shield. This is used if the knife assembly is taken off the housing of the slicing machine. The safety latch is elastically pre-tensioned, and is pressed into its unlocked position by combined action with the housing.

In accordance with still an added feature of the invention, the key is rotatably or slideably supported on the protective shield and includes a handle for operating the locking means.

In accordance with still an additional feature of the invention, the key is fixedly connected to the protective shield, and the protective shield serves as a handle for the key. This has the advantage of ensuring that with the relatively large protective shield, even greater forces can be applied for the operation of the lock. This makes the servicing of the machine considerably easier, especially for older users.

The protective shield can be provided with permanent magnets which preferably act in conjunction with the cutting tool and serve to fasten the shield to the cutting tool. Preferably, several magnets, for example three, are uniformly distributed over the area of the protective shield. The special advantage of the permanent magnets lies in the fact that it is difficult to separate the cutting tool assembly from the protective shield if it is not connected with the housing of the slicing machine, because it has no suitable handle itself.

As an alternative, or in combination with the magnetic attachment, in accordance with another feature of the invention, the protective shield includes a mechanical, manually operable latch for fastening the protective shield to the cutting tool assembly, and the cutting tool assembly includes a handle cooperating with the latch for opening the locking means.

Preferably, a sliding latch for fastening it to the cutting tool assembly is used. The mechanical locking device has the advantage, that it also does not come apart upon a sudden impact load, as could happen if the protective shield is dropped together with the cutting tool assembly attached thereto. The combination of permanent magnets with a mechanical locking device has the great advantage, in the case an accidental operation of the mechnical locking device, of preventing the cutting tool assembly from falling off the protective shield, because it is still magnetically held. On the other hand, upon a strong impact which could break the magnetic hold, the mechanical locking device assures the connection of the parts. A further, additional safety measure can also be achieved by the feature of having the afore-described safety lock which is disposed at the cutting tool assembly, working in conjunction with the locking device, and arresting the locking device in the closed position, as long as the cutting tool assembly is not mounted to the housing of the slicing machine, and the safety lock itself is pressed by the housing into its unlocked position.

The cutting tool assembly may be provided with a handle for loosening the lock connecting it to the housing, so that the lock can also be operated without the aid of the protective shield. The handle can be constructed at the same time in such a way that it offers a point of application for the locking device of the protective shield.

In accordance with a further feature of the invention, the protective shield includes a handle extended beyond the cutting edge.

In accordance with a concomitant feature of the invention, the handle has a hole formed therein for hanging in storage.

Other features which are considered as characteristic for the invention are set forth in the appended claims.

Although the invention is illustrated and described herein as embodied in an electromotively drive household slicing machine for food, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which:

FIG. 1 is a diagrammatic perspective view of a household slicing machine as seen from the side facing away from the cutting tool;

FIG. 2 is an additional perspective view of the appliance according to FIG. 1, as seen from the cutting tool side;

Figure 5:
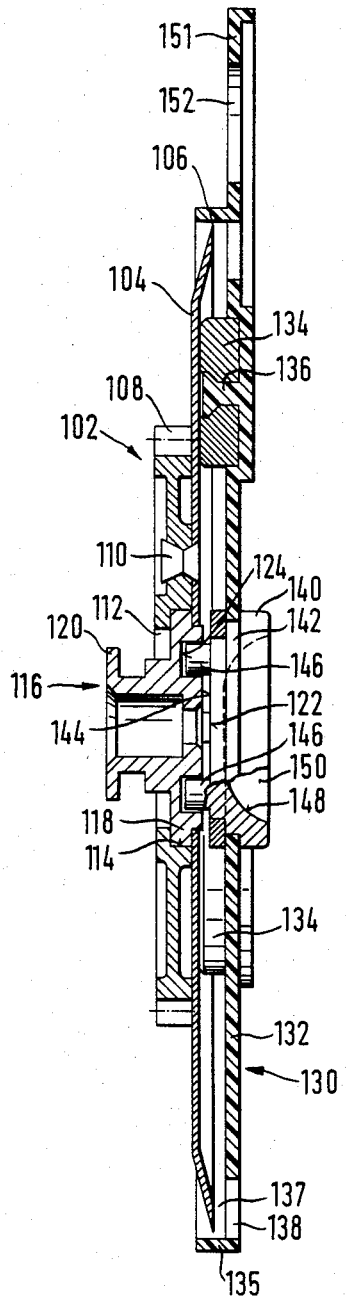
FIG. 5 is a vertical sectional view taken essentially along the line V—V in FIG. 6 in the direction of the arrows, showing the cutting tool subassembly with the circular knife in connection with a protective shield detached from the slicing machine.
Figure 7:
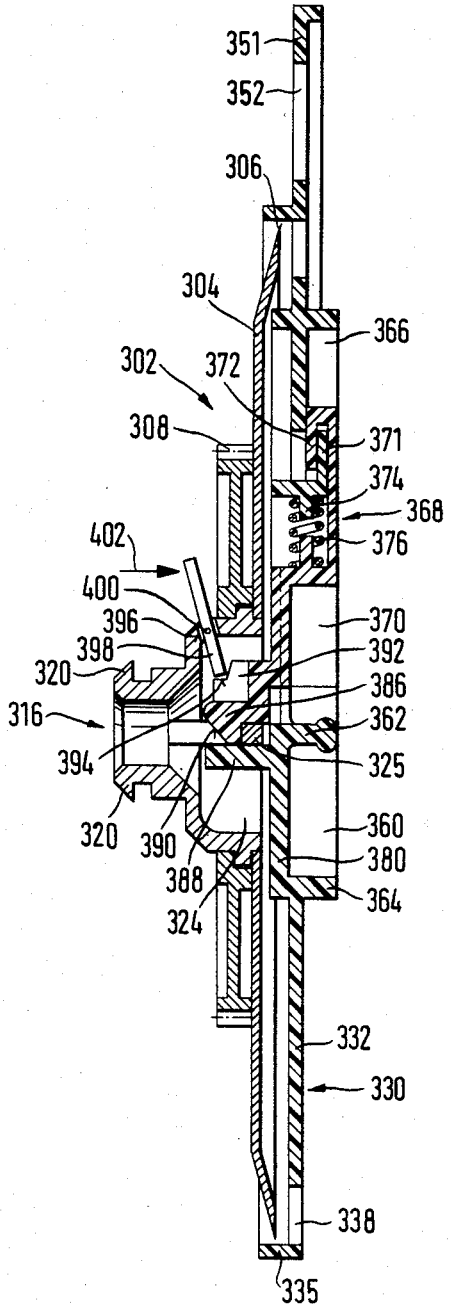
Figure 6:
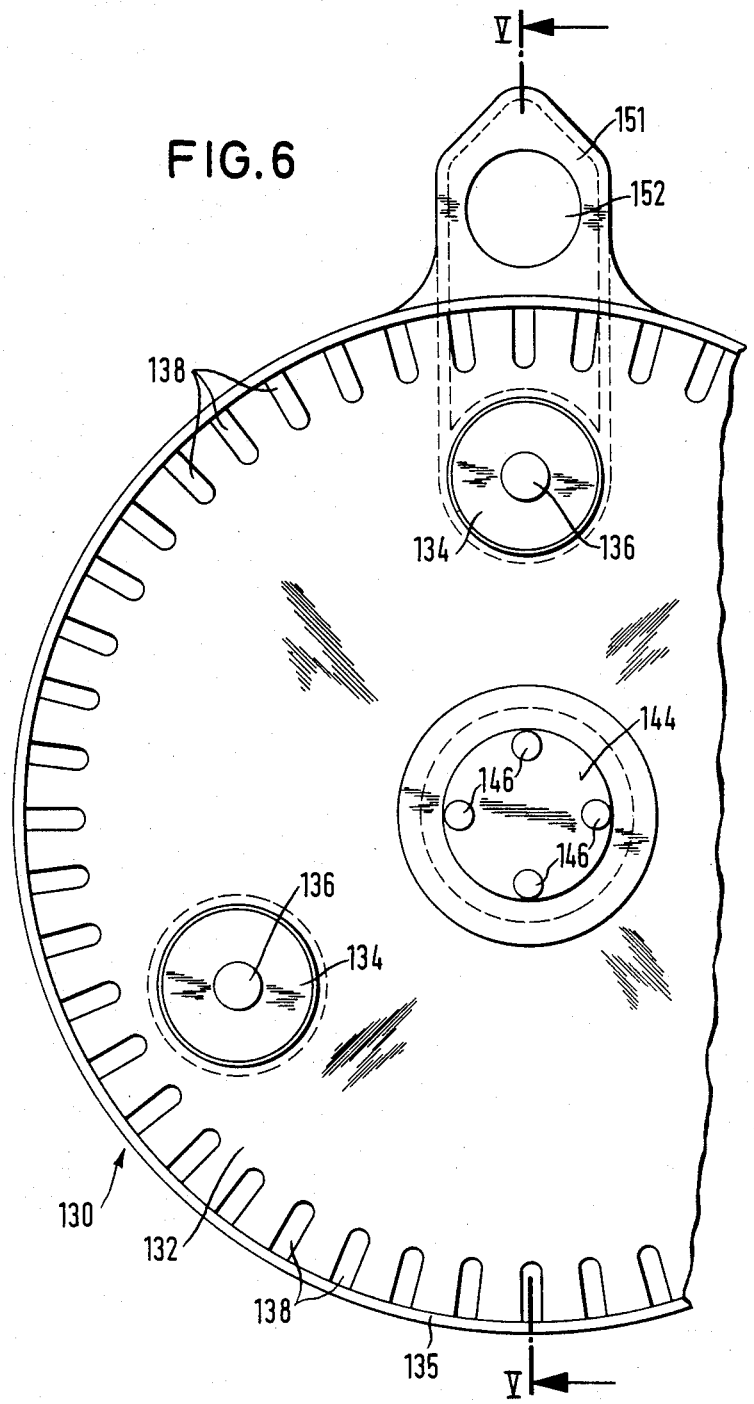
FIG. 6 is a fragmentary elevational view of the protective shield according to FIG. 5 without the cutting tool assembly, as seen from the left hand side of FIG. 5.
Figure 8:
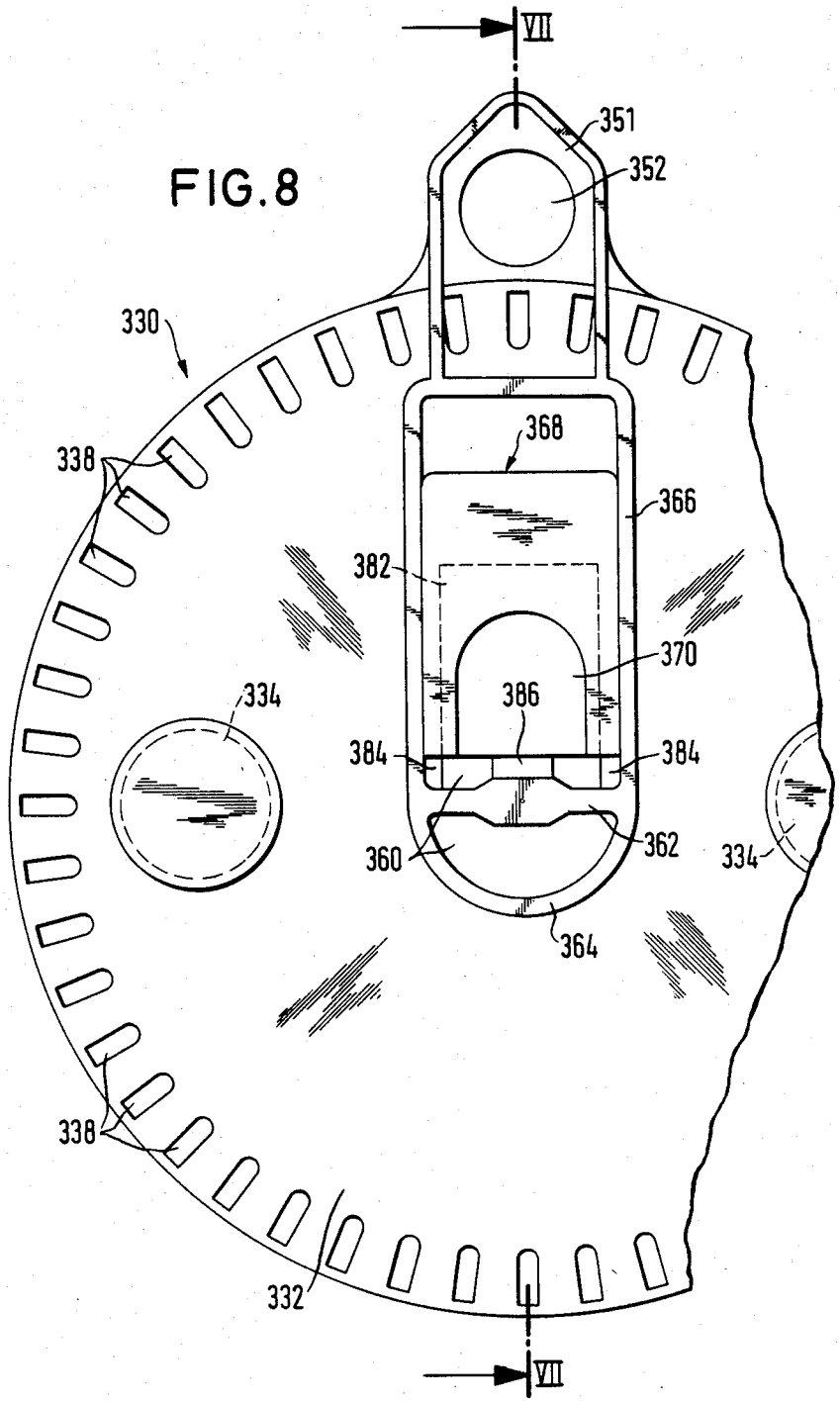

FIG. 7 ia a view similar to FIG. 5 of another embodiment of the cutting tool assembly and the protective shield, taken essentially along the line VII—VII in FIG. 8 in the direction of the arrows; and FIG. 8 is a view similar to FIG. 6 of the protective shield according to FIG. 7, as seen from the right hand side of FIG. 7.

Referring now to the figures of the drawing in detail and first particularly to FIG. 1 thereof, there is seen a household slicing machine, a so-called universal slicer, which is designated with reference numeral 10 and which includes a housing 11 which, as a whole, has a prismatic or parallelepipedal shape, and rests in the operation position on a base 12 that protrudes toward the side. The housing 11 is provided with a frame-like section 13, in which an adjustable stop plate 14 is disposed. On the side of the housing 11 opposite the frame-like section 13, a drive module or block 15 is disposed, for driving the slicing machine 10. The drive module 15 drives a circular knife 16 which is fixedly connected with a gear 16', as shown in FIGS. 2 and 4.

Figure 3:
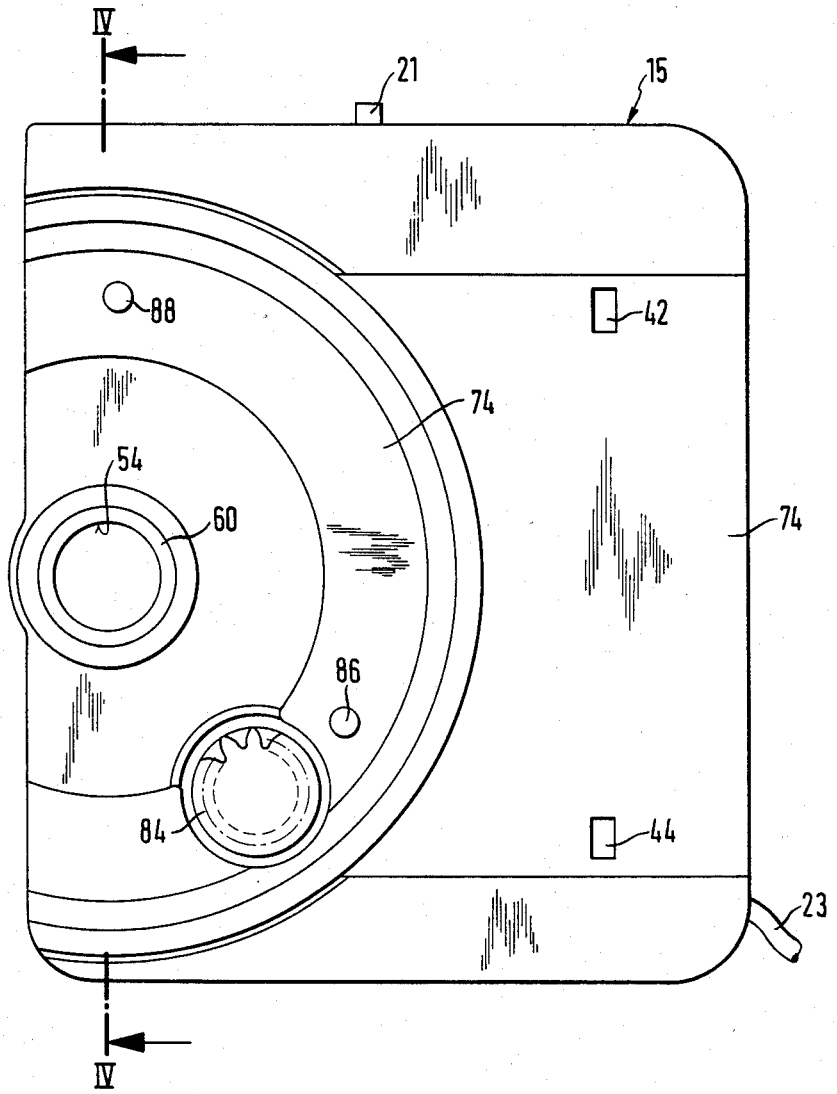
FIG. 3 is a side elevational view on an enlarged scale of the detached drive unit of the device according to FIGS. 1 and 2, as seen from the side turned toward the cutting tool.
Figure 4:
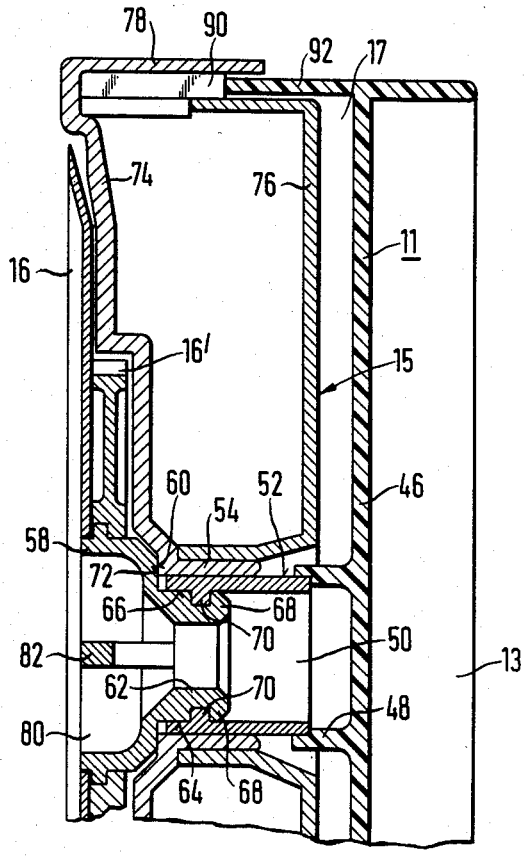
FIG. 4 is a fragmentary cross-sectional view taken essentially along the line IV—IV in FIGS. 1 to 3, in the direction of the arrows.

As clearly shown in FIGS. 2 to 4, the drive module 15 is constructed as an integral body enclosed in its own housing, so that it is form-lockingly and easily detachably connected to the housing 11 of the slicing machine 10. The term "form-locking" refers to a connection wherein parts are locked together by virtue of their own shape, requiring no other fasteners. For this purpose, the housing 11 is provided at the side thereof facing toward the circular knife 16 with a recess 17, into which the drive module 15 can be inserted. The end section of the recess 17 facing toward the cutting plate 14, is tapered in a wedge shape, as seen from the top.

The detachable drive module 15 is provided with various switching and control elements for controlling the motion and number of revolutions of the drive motor, such as a power switch 20 and a regulator or governor in form of a slider switch 21, as well as a line 23 for connection with the electrical network. The slicing machine 10 is provided with a working surface or plate 33 for supporting and guiding the object to be sliced. The working surface is detachable and can be folded up into a storage position. The circular knife 16 and the wall of the drive module 15 projecting above the circular knife are covered by a knife cover 40 when the device is in the operating condition (in FIG. 2 the knife cover is shown as being detached). The cover 40 has non-illustrated fastening means at the rear thereof which engage in openings 42 and 44 formed in the motor unit, and are secured therein. At the same time, the fastening means close a switch provided in the current circuit of the drive motor. If the knife cover 40 is removed, the current circuit is interrupted, thus increasing the safety for the user in a known manner. In this way, the motor cannot be started by operation of the switch 20.

The part of the housing 11 which receives the drive module 15 is constructed in the form of a shell which is open toward the side thereof facing the knife. The housing 11 is provided with a back wall 46 which faces away from the knife. The inner surface of the wall 46 is provided with a boss or lug 48 which is concentric to the axis of the knife 16. A centralizing member in form of a bushing 50 is disposed in the boss or eye 48, in such a manner that during operation the bushing 50 cannot be loosened, or can only be loosened with difficulty. The bushing 50 has a bearing surface 52 at the outside thereof, onto which the drive module 15 can be mounted with a boss 54 for centralization. The inner surface of the boss 54 is constructed as a sleeve-type bearing surface.

The knife 16 is in fixed connection with the gear 16', and both parts together are rotatably supported at the outer periphery of a bearing member 58. The bearing member 58 protrudes toward the housing wall 46, and is provided with a tapered centralizing and connecting portion having a shoulder 60, and being constructed as a socket 62 with a bearing surface 64 at its outer periphery. The support surface 64 serves, together with a bearing surface 66 on the inner periphery of the bushing 50, which serves as a centering device and connection means for the cutting tool, to centralize the knife assembly and to connect the housing 11. For this purpose, prongs 68 are provided at the end of the socket 62, which are directed outwardly and engage behind bayonet prongs 70, which project from the interior of the bushing 50 which serves as centering means. All of the bayonet prongs 68 and 70 are helically shaped, so that upon a rotation of the bearing part 58 of the knife, the bearing part 58 is pulled in against the back wall 46 of the housing 11, and presses with its shoulder 60 against a shoulder 72 of the socket 54 of the housing of the drive module 15. The housing of the drive module is formed by a shell 74 which faces toward the knife, abd by a shell 76 which faces toward the housing wall 11, so that the two shells are fitted into each other. An operating panel 78 in which the switches 20 and 21 are disposed, is provided in the shell 74 which is turned toward the knife.

The bearing support 58 of the knife has a grip opening 80 and a gripper bar 82 disposed therein, as seen in FIGS. 2 and 4.

The drive module 15 includes a drive pinion 84 disposed toward the side of the socket 54 for driving the gear teeth 16' of the knife 16. The axis of rotation of the drive pinion 84 is parallel to the axis of the centralization means which is in the form of the bushing 50. Furthermore, slide knobs or pins 86 and 88 are inserted into the housing shell 74 and act in conjunction with the rear side of the knife 16, to help support the circular knife.

After cleaning, when putting the appliance together, the drive module 15 is first pushed onto the bearing surface 52 serving as a centralizing device and as connection means at the back wall 46, and then the knife assembly is gripped at the gripper bar 82 in the middle of the knife, centered in the interior of bushing 52, and anchored there by rotating. By virtue of the rotation, the bearing member 58 of the knife assembly is pulled with its shoulder 60 against the shoulder 72 of the socket 54 of the drive module 15, and the bearing member 58 presses the drive module into the shell-shaped recess 17 of the housing 11. In this way, support ribs 90 under the operating panel 78 contact the edge of a cover wall 92 of the housing which faces toward the knife 16, thereby clamping the drive module 15 between the housing 11 and the bearing member 58 of the knife assembly. Thus, the drive module 15 and the knife assembly are secured in the axial direction as well as in the direction perpendicular to the axis of rotation of the knife.

The cutting tool assembly shown in FIGS. 5 and 6 is formed of a circular knife 104 made of steel with a peripheral cutting edge 106. A drive gear 108 is fastened with rivets 110 to the circular knife 104, and is provided with a central opening 112 having a peripheral groove 114 in which a collar 116 engages with a support flange 118. The support flange 118 has a fastening boss at the side thereof facing away from the circular knife 104, with radially extending coupling prongs 120. The prongs 120 of the cutting tool assembly 102 represent a part of a locking device serving to secure this assembly to the housing of a non-illustrated food slicing machine. The other end of the collar 116 extends through a central bore formed in the circular knife 104 and the collar 116 is provided at an end face 122 thereof toward the knife with four cylindrical recesses 124 which are parallel to the axis and distributed around the periphery.

A protective shield 130 is provided having a round plate 132 parallel to the surface of the circular knife 104. Adjacent the edge of this plate 132, there are three permanent magnets 134 uniformly distributed around the collar 116 and fastened by rivets 136, which act together with the circular knife 104 to hold the cutting tool assembly 102 at the plate 132. A peripheral edge section 135 projects at a right angle to the outer edge of the plate 32. Part of the edge section 135 extends over the cutting edge 106 of the circular knife 104 and protects the cutting edge. There is a spacing 137 between the cutting edge 106 and the plate 132. The plate 132 is provided with windows 138, which extend inward and are distributed around the plate, so that cleaning liquids, especially the water jets of a dishwasher, can reach the circular knife 104. The plate 132 is provided with a central, round perforation in which a key or wrench in the form of a round plate 140 with a peripheral groove 142, is guided. At an end surface 144 of the plate 140, which faces toward the collar 116, cylindrical projections 146 are provided which engage in the recesses 124 formed in the collar 116, so that the projections can drive the collar around the knife axis. At the end face of the key 140 which faces away from the circular knife 104, are two recesses 148 between which a bar 150 is left remaining. This bar is disposed across the axis of the circular knife 104, and serves as a handle for the key.

When the cutting tool assembly 102 is mounted in the slicing machine, its collar 116 is centered in the housing of the slicing machine, and is secured by the prongs 120 which form the locking means. A pinion engages in the gear 108, and can drive the gear together with the circular knife 104, around the stationary collar 116. To remove the cutting tool assembly 102 from the machine, the protective shield 130 is inserted from the knife side into the cutting tool assembly, at which point the key 140 must be turned until its projections 146 engage the recesses 124 of the collar 116. The permanent magnets 134 then contact the outer surface of the circular knife 104, and thereby connect the cutting tool assembly 102 with the protective shield 130. The protective shield 130 is then gripped at a lug 151 through a hanging hole 152 which is a radially extended elongation formed in the plate 132. The key 140 is turned in the unlocking direction of the lock, until the coupling prongs 120 are disengaged from the housing of the non-illustrated slicing machine, and the cutting tool assembly 102 together with the protective shield 130 can be detached from the machine. The mounting of the knife is also performed with the aid of the protective shield 130. The key 140 is turned in the locking direction of the lock. Then the protective shield 130 is withdrawn from the circular knife overcoming the force of the permanent magnets 134.

In the modified embodiment according to FIGS. 7 and 8, a cutting tool assembly 302 is provided, including a circular knife 304 with a peripheral cutting edge 306, to which a gear 308 is fastened. These parts are mostly identical with the corresponding parts of the embodiment according to FIGS. 4 and 5. However, they are supported on a differently constructed collar 316. This collar 316 has coupling prongs 320 for fastening it to the housing, a large central recess 324 formed therein at the side facing toward the knife, and a gripper bar 325 which extends along the end face across the recess. In this case, the cutting tool assembly 302 can be removed by itself by reaching into the recess 324 and by turning the collar 316 with the coupling prongs 320 by means of the bar 325. This opens the locking means which hold the cutting tool assembly 302 to the housing of the slicing machine.

A protective shield 330 is provided, which is formed of a plate 332 with a peripheral wall section perpendicular to the plate 332, which covers the cutting edge 306 of the circular knife 304. The shield 330 also includes a window 338 for the injection of rinsing water. Furthermore, the protective shield 330 has a lug 351 with a hole 352 formed therein for hanging, which extends beyond the outside of the shield, as an elongation of the plate 332. Two permanent magnets 334 are fastened to the plate 332 adjacent the outer periphery at the side facing toward the circular knife, so that the magnets adhere to the circular knife which is made of steel. In the middle region of the plate 332 there is a flat gripping depression 360 through which a gripper bar or hand-grip 362 extends perpendicular to the axis of the cutting tool assembly 302. The depression 360 is enclosed at the side facing away from the circular knife 304 by a frame 364 which projects parallel to the axis, and which has an enlargement near the lug 351 in the form of a rectangular frame 366. A sliding latch 368 with a recess 370 for gripping is guided in the frame 364 so that it can slide in radial direction. To hold the sliding latch 368 in contact with the plate 332, the plate is provided within the frame 366 with a hook-like projection 371 at the side facing away from the circular knife. The projection 371 first projects parallel to the axis and then perpendicular to it and parallel to plate 332. The locking latch 368 is provided at the end thereof which is distant from the axis, with a hooked portion 372, which engages between the hooked projection 371 and the plate 332. At the side of the hooked projection 371 which faces toward the axis, a centering boss 374 is provided, on the outer end of which a compression spring 376 is mounted. The inner end of the spring which faces toward the axis of rotation of the circular knife, acts upon the sliding latch 368, and urges the latch toward the axis. Referring to FIG. 8, the gripper recess or depression 360 has a bottom 380 which extends parallel to the plate 332, in which a perforation 382 is provided above the bar 362. The perforation extends below the sliding latch 368, and is provided at its edges with sliding guides 384 in which the sliding latch 368 is guided at the side facing away from the circular knife 304. A locking hook 386 extends through the perforation 382 into the gripper recess 324 of the collar 316 and behind the gripper bar 325 disposed in the recess 324 to lock the protective shield 330 in position. Additionally, a key projection in the form of a cross latch 388 extends from the bottom 380 of the protective shield 330 past the bar 325 into the recess 324 of the collar 316, and the cross latch 388 is in contact with the side of the bar 325 in the recess 324. The detent or hook 386 is pressed by the compression spring 376 against the cross latch 388, and the hook 386 is also provided with a slanted surface 390 which acts together with the bar 325 when the protective shield 330 is put in place, to automatically press the sliding latch 368 laterally against the pre-loaded force of the spring 376. The rear side of the detent or hook 386 facing away from the bar 325 is provided with a support rib 392 in which a detent step 394 is provided. In vicinity of the recess 324, the wall of the collar 316 is perforated by an opening 396 through which a safety latch in the form of a pivotable lever 398 protrudes. The lever is pivotable in the wall of the collar 316 about an axis 400 which is parallel to the bar 325. The lever 398 is pressed by a non-illustrated spring into contact against the latching or detent step 394 of the rib 392, to prevent a movement of the sliding latch in the unlocking direction, as long as the free end of the lever which extends through the collar to the outside is not pressed through the housing in the direction of an arrow 402. Pressure against the lever 398 in the direction of the arrow 402 moves the inner part of the pivotable lever 398 out of engagement with the detent step 394.

In the operating condition, when the cutting tool assembly is mounted in the slicing machine, the cutting tool assembly 302 is centered and secured with its collar 316 in the housing of the slicing machine, and the housing presses the hinged lever 398 into a vertical position. To remove the cutting tool assembly 302, the protective shield 330 is placed on the circular knife 304, so that the detent or hook 386 is pushed aside against the action of the spring 376, and engages behind the bar 325. In this position, the permanent magnets 334 are also in contact with the circular knife 304. It is now possible to grip the protective shield by its gripper bar 362 and its lug 351 and to turn the shield 330 a certain distance about the knife axis. In this way, the circular knife remains stationary, and the bar 388, which serves as a key and extends into the collar, rotates the collar 316 by engagement with the bar 325 and opens the locked connection of the coupling prongs 320. Subsequently, the protective shield can be detached from the slicing machine in axial direction together with the cutting tool assembly 302. A non-illustrated spring moves the safety latch in the form of the pivotable lever 398 against the latching step 394, thereby providing security against the unintentional unlocking of the sliding latch. After cleaning of the slicing machine and the cutting tool assembly, the cutting tool assembly is again attached to the housing with the aid of the protective shield 330, and is fastened to the housing by turning the protective shield in the locking direction. In this way, the gear is engaged with a drive pinion in the housing, to secure the gear and the circular knife 304, and the permanent magnets 334 slide on the surface of the knife by rotation of the protective shield 330. When the assembly is placed onto the housing, the pivotable lever 398 is already moved to its unlocking position, and the sliding latch 398 can be moved radially outward, so that the mechanical connection is disconnected and the protective shield 330 can be detached from the cutting tool assembly 302 in the axial direction, against the acting force of the permanent magnets.

The foregoing is a description corresponding in substance to German Applications No. P 32 28 768.8, dated May 18, 1982 and No. P 32 23 450.3, dated June 23, 1982, the International priorities of which are being claimed for the instant application and which are hereby made part of this application.

I claim:

1. Slicing machine, comprising a housing, a cutting tool assembly having a side facing away from said housing, said cutting tool assembly including a cutting tool having a cutting edge for slicing and means for detachably locking said cutting tool assembly to said housing, and a protective shield being fastenable to said cutting tool assembly and protruding beyond said cutting edge at said side of said cutting tool assembly facing away from said housing, said protective shield including a key for operating said locking means.

2. Slicing machine according to claim 1, wherein said key is movably supported on said protective shield and includes a handle for operating said locking means.

3. Slicing machine according to claim 1, wherein said key is fixedly connected to said protective shield, and said protective shield serves as a handle for said key.

4. Slicing machine according to claim 1, wherein said protective shield includes a mechanical, manually operable latch for fastening said protective shield to said cutting tool assembly, and said cutting tool assembly includes a handle cooperating with said latch for opening said locking means.

5. Slicing machine according to claim 1, including a safety latch for latching said protective shield to said cutting tool assembly, said safety latch being operable in cooperation with said housing for detaching said protective shield.

6. Slicing machine according to claim 1, wherein said protective shield includes a handle extended beyond said cutting edge.

7. Slicing machine according to claim 6, wherein said handle has a hole formed therein for hanging in storage.

8. Slicing machine according to claim 1, wherein said operating means are in the form of a key.

9. Slicing machine according to claim 2, wherein said operating means are in the form of a key.

10. Slicing machine according to claim 3, wherein said operating means are in the form of a key.

11. Slicing machine according to claim 1, wherein said operating means are in the form of a gripper.

12. Slicing machine according to claim 1, including permanent magnets holding said protective shield to said cutting tool assembly.

* * * * *